United States Patent [19]

Nakada et al.

[11] Patent Number: 4,640,028

[45] Date of Patent: Feb. 3, 1987

[54] COMBINATION STEAM IRON AND STEAMER

[75] Inventors: Seiichi Nakada, Amagasaki; Tool Hanada, Takarazuka; Masao Watanabe, Toyonaka, all of Japan

[73] Assignee: Matsushita Electric Industrial Co., Ltd., Osaka, Japan

[21] Appl. No.: 738,180

[22] Filed: May 28, 1985

[30] Foreign Application Priority Data

Jun. 1, 1984 [JP] Japan ..... 59-113333

[51] Int. Cl.[4] ..... D06F 75/18

[52] U.S. Cl. ..... 38/77.7; 38/778; 38/92; D32/72; 16/114 R

[58] Field of Search ..... 190/115, 117; 294/137, 294/167, 169; D32/68, 69, 70, 71, 72; 219/254, 488, 249, 250, 255, 252; 220/94 R; 16/378, 112, 126; 38/92, 77.5, 77.4, 90, 77.8, 89, 85, 77.7, 77.83

[56] References Cited

U.S. PATENT DOCUMENTS

| | | | |
|---|---|---|---|
| 2,763,075 | 9/1956 | Vance | 38/77 |
| 2,813,358 | 11/1957 | Jepson | 38/77.7 |
| 3,001,305 | 9/1961 | Sardeson | 38/77.7 |
| 3,111,780 | 11/1963 | Smith | 38/77.7 |
| 3,229,392 | 1/1966 | Camilleri | 38/90 |
| 4,091,551 | 5/1978 | Schaeffer | 38/77.83 |
| 4,484,399 | 11/1984 | Biancalani | 38/77.8 X |

FOREIGN PATENT DOCUMENTS

| | | | |
|---|---|---|---|
| 2538243 | 10/1977 | Fed. Rep. of Germany | 38/77.8 |
| 2532526 | 10/1977 | Fed. Rep. of Germany | 38/77.8 |

*Primary Examiner*—Werner H. Schroeder
*Assistant Examiner*—Andrew M. Falik
*Attorney, Agent, or Firm*—Stevens, Davis, Miller & Mosher

[57] ABSTRACT

A portable travel electric steam iron which also functions as a steamer has an aperture provided in a rear portion of the bottom of a water tank which supplies water into steam generating chambers from the water tank. Water dripping through the aperture is received by a water receiving surface provided on the center or on the front side of the center of a base. A handle which includes two straight positions separated by a bend is securable to an iron main body both in the operative position and storage position. An actuator for opening and closing an aperture is disposed in a space above the water tank, in the vicinity of a fixing portion at which the handle is fixed to the iron main body, thus providing a compact construction which is easy to handle.

6 Claims, 14 Drawing Figures

COMBINATION STEAM IRON AND STEAMER

BACKGROUND OF THE INVENTION

This invention relates to a small-sized electric iron which is handy to carry while travelling and which has both a steaming function for smoothing clothes on hangers or a rack and a pressing function which is substantially the same as that performed by an ordinary steam iron.

In general, an instrument called a "steamer" has a function to smooth clothes on a hanger or a rack by jetting steam to the clothes from nozzle ports which are communicated with a water boiling chamber therein, as shown in U.S. Pat. No. 3,690,024. This instrument, however, has no pressing function because it is devoid of a hot pressing plate.

In order to obviate this shortcoming, U.S. Pat. No. 3,733,723 proposes an instrument which has a hot pressing plate, steam jetting ports provided in the hot pressing plate, a contractable water tank and a spring for contracting the water tank such as to forcibly supply the water to a steam generating chamber. This instrument can serve both as a steamer and a steam iron because it has means for supplying water to the steam generating chamber and the hot pressing plate for pressing clothes. This instrument, however, is not suited to a portable design because there is a practical limit in the reduction of the size, due to the use of a boosting type water supply system.

On the other hand, some proposals have been made for irons which employ a simple dripping type water supply system and which can jet the steam even when they are held vertically. Typical examples of such irons are shown in U.S. Pat. Nos. 2,908,092 and 3,986,282. Both of these irons have a water tank and nozzles for dripping water and are capable of jetting steam both when they are used in pressing clothes and when stationed vertically.

The iron proposed by U.S. Pat. No. 2,908,092, however, suffers from a disadvantage in that, since the water dripping nozzles are positioned ahead of the water tank, most of the water in the water tank cannot drip through the nozzles when the iron is used in a vertical position as a steamer. Thus, most of the water supplied to the water tank cannot be changed into steam and a frequent supply of water into the water tank is necessary. Also, when the water level has been reduced almost to a half of the full level, the water splashes up and down in the water tank during the use of the iron, resulting in a discontinuous dripping and, hence, in a steaming failure.

These problems are overcome by the iron disclosed in U.S. Pat. No. 3,986,282 in which the water dripping nozzles are disposed at the rear side of the water tank. In this case, however, the supply of water to the steam generating chamber is inevitably made at the rear portion of the base, i.e., at the rear side of the heater. In general, the rear portion of the base receives less heat than the front portion thereof because the front portion of the base is usually surrounded at its three sides by the heater which is bent in a U-like form. In order to generate the steam efficiently and stably, therefore, it is necessary to supply the rear portion of the base with a sufficient amount of heat to evaporate the water into steam. This in turn requires an increase in the capacity of the heater as a whole, as well as a longer time of supply of electric power to the heater. Consequently, the iron is heated excessively to a dangerous level and a large amount of electric power is wasted.

U.S. Pat. Nos. 2,761,228 and 2,786,287 disclose portable steam irons which have a handle swingably secured to a rear portion of the iron and a water tank detachably secured to the iron body. The portable iron proposed by U.S. Pat. No. 2,761,228, however, as a whole has a considerable size even when the handle is rotated downwardly because the water tank projects to a large extent. When this steam iron is carried by a traveller, therefore, the water tank must be separated from the main body of the iron. The dismounting and carrying of the water tank undesirably increases the total volume to be carried, and requires a specific casing for encasing the main body of the iron and the water tank. The same problem is encountered also by the portable iron proposed by U.S. Pat. No. 2,786,287. In addition, the portable iron of the U.S. Pat. No. 2,786,287 has no means for switching the operation between a steaming mode and a dry mode. Namely, this portable iron operates either in steaming mode or in dry mode, depending on whether the water tank contains water or the water tank is empty, and it is not possible to instantaneously stop and start steaming. In contrast, the portable iron of U.S. Pat. No. 2,786,287 is provided with a change-over device which is provided in the water tank, and is positioned remote from the handle. As a result, a user can not operate the change-over device using one hand while ironing.

SUMMARY OF THE INVENTION

Accordingly, an object of the invention is to provide a portable steam iron having a steaming function, which fully overcomes the above-described problems of the prior art.

To this end, according to the invention, there is provided a steam iron with a steaming function, wherein an opening through which water is supplied to a steam generating chamber is disposed in a rear portion of the bottom of the water tank, while water is supplied at a central portion of a base or at a portion forward of the central portion within the area surrounded by a heater.

With this arrangement, it is possible to eject the whole part of the water in the water tank as steam both in the pressing and steaming modes, while reducing the required capacity of the heater and, hence, eliminating the risk of excessive heating of the iron.

In one aspect of the invention, a handle has a gripping portion and a fixing portion fixed to the main body of the iron, the gripping portion and the fixing portion being connected to each other through a bend. This bend affords an ample space about the gripping portion when the iron is being used. When the iron is not used, the handle is turned upside down and fixed to the main body of the iron such that the handle does not project beyond the height of the main body of the iron. Therefore, the iron as a whole can be carried with the handle mounted to the iron body.

In another aspect of the invention, a manual operating portion for a device for opening and closing the opening is provided in a space above the water tank, in the vicinity of which space the fixing portion of the handle is provided. Therefore, the user can get access to a steaming button for easy ejecting and stopping of steam, while holding the handle and performing various operations both in the pressing mode and steaming mode.

DESCRIPTION OF THE PREFERRED EMBODIMENT

Figure 1:
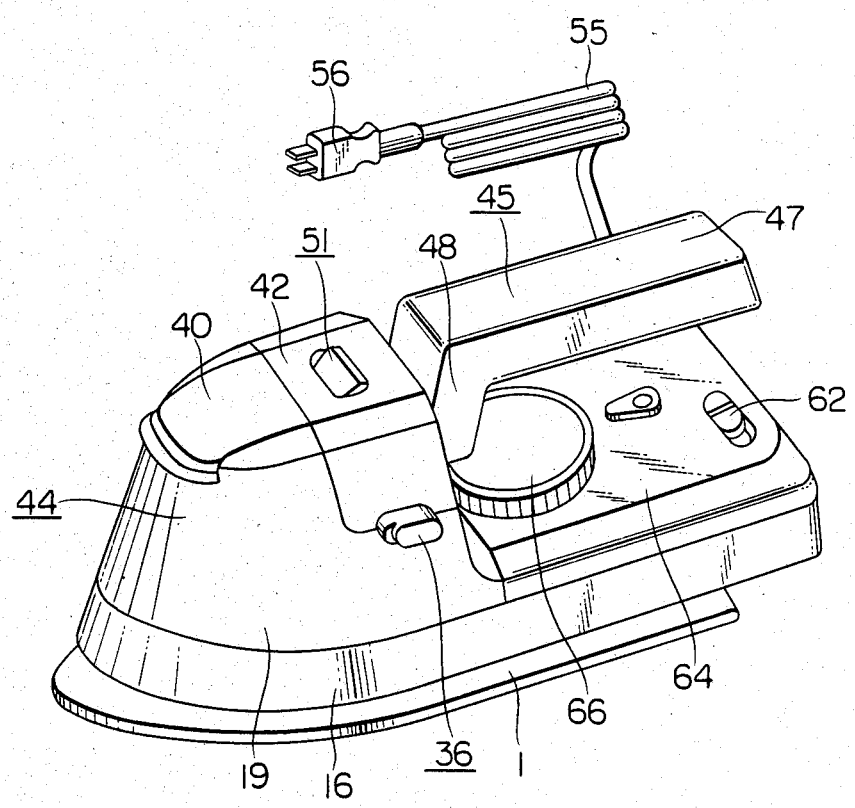
FIG. 1 is a perspective view of a travel steam iron according to an embodiment of the invention.
Figure 2:
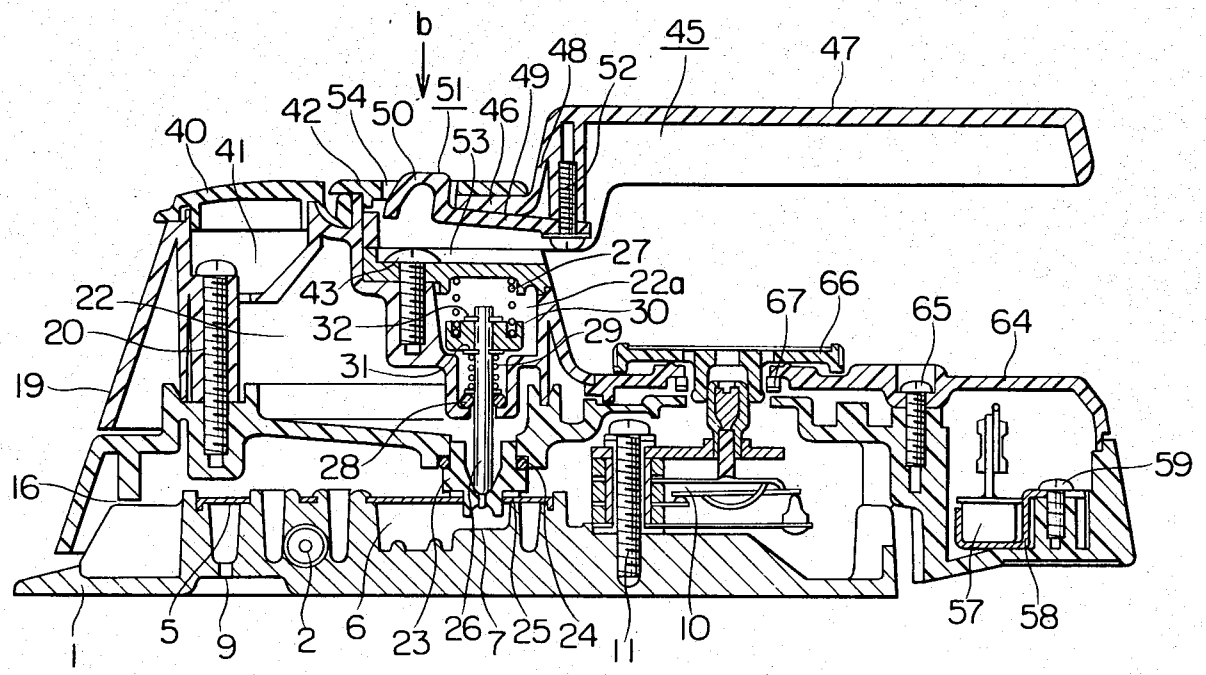
FIG. 2 is a sectional side elevational view of the travel steam iron shown in FIG. 1.

Referring to FIGS. 1 to 11, a traveler steam iron according to an embodiment of the invention has a base 1 cast from aluminum and an electric heater 2 embedded therein (referred to simply as "heater", hereinunder). The heater 2 is bent to be U-shaped with its both ends positioned readly of the base 1. Reference numeral 3 denotes conductive metal fittings electrically connected to terminals 4 of the heater 2. A lid 5 for an evaporation chamber is adapted to fit on the base 1 such as to form the evaporation chamber together with the base 1. A first steam generating chamber 6 positioned inside of the U-shaped portion of the heater 2 is provided with a water receiving surface 7 which is located substantially at the center of the base 1 and protruding from the remaining surface of the base 1. With this arrangement, water is made to drip onto the surface 7 to be evaporated and the steam thus generated is jetted outside from a second steam generating chamber 8 constituting a steam passage through a plurality of steam ports 9 which are provided in the portion of the base 1 defining the second steam generating chamber 8.

Figure 3:
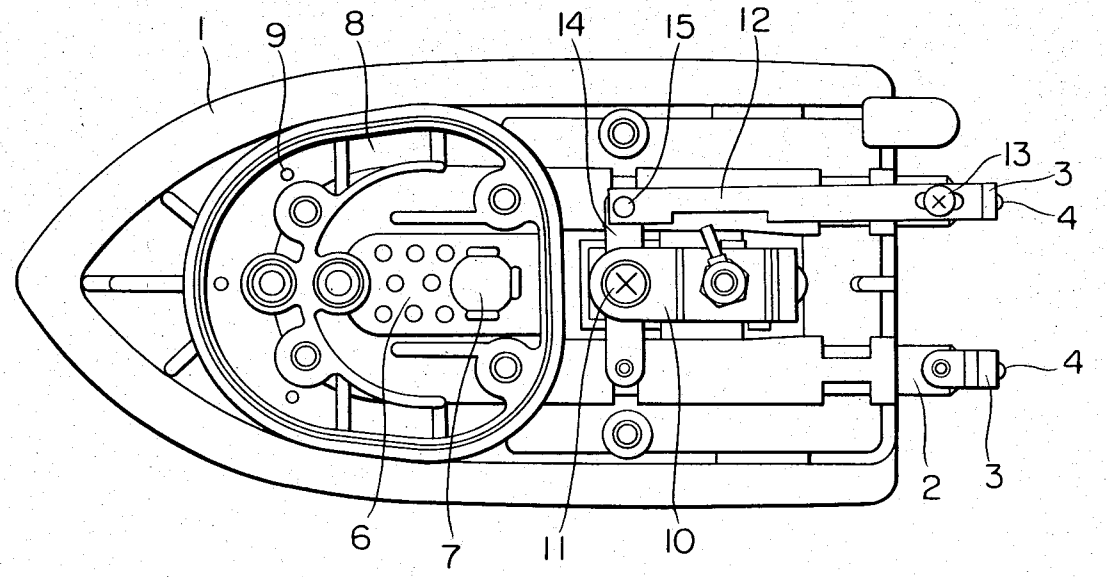
FIG. 3 is a top plan view of a base portion of the travel steam iron shown in FIG. 1.

A reference numeral 10 designates a thermostat for controlling the supply of electric power to the heater 2. As shown in FIG. 3, the thermostat 10 is fixed to the base 1 by means of a screw 11. A reference numeral 12 designates a spring member made of a copper alloy and having one end fixed to one of the conductive metal fittings 3 by means of a screw 11 and the other end biased away from a terminal 14 of the thermostat 10 and fixed to this terminal 14 by means of a rivet 15, thus forming an electric circuit. The rivet 15 is made of an eutectic alloy consisting mainly of lead. When temperature control by the thermostat 10 becomes unavailable, this rivet serves to avoid fire which may otherwise be caused due to uncontrolled continuous electric power supply to the heater 2. Namely, when the heater 2 is supplied with electric power continuously, the temperature of the base 1 is raised, so that the temperature of the rivet 15 is raised correspondingly. The composition of the eutectic alloy from which the rivet 15 is made is selected such that the rivet 15 melts down before melting of the base 1 or production of a fire. Since the rivet 15 has melted, the spring 12 moves away from the terminal 14 of the thermostat 10 to shut-off the circuit, thereby stopping the supply of power to the heater 2.

Figure 5:
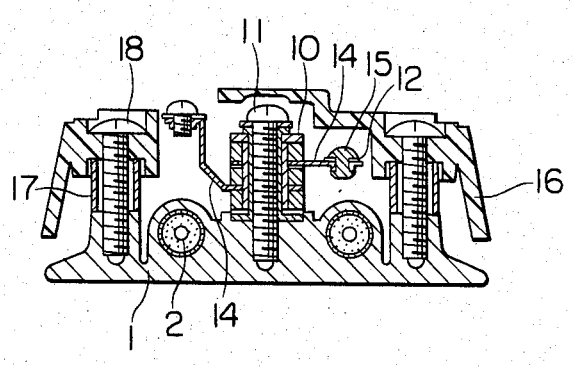
FIG. 5 is a sectional view showing a thermostat and a rivetted portion.
Figure 6:
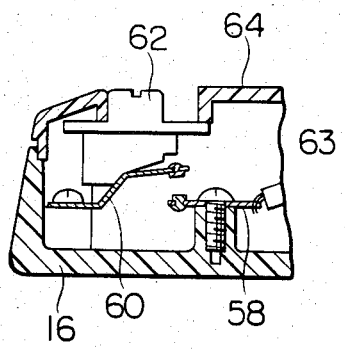
FIG. 6 is a sectional view of an essential part of a voltage change-over switch.
Figure 7:
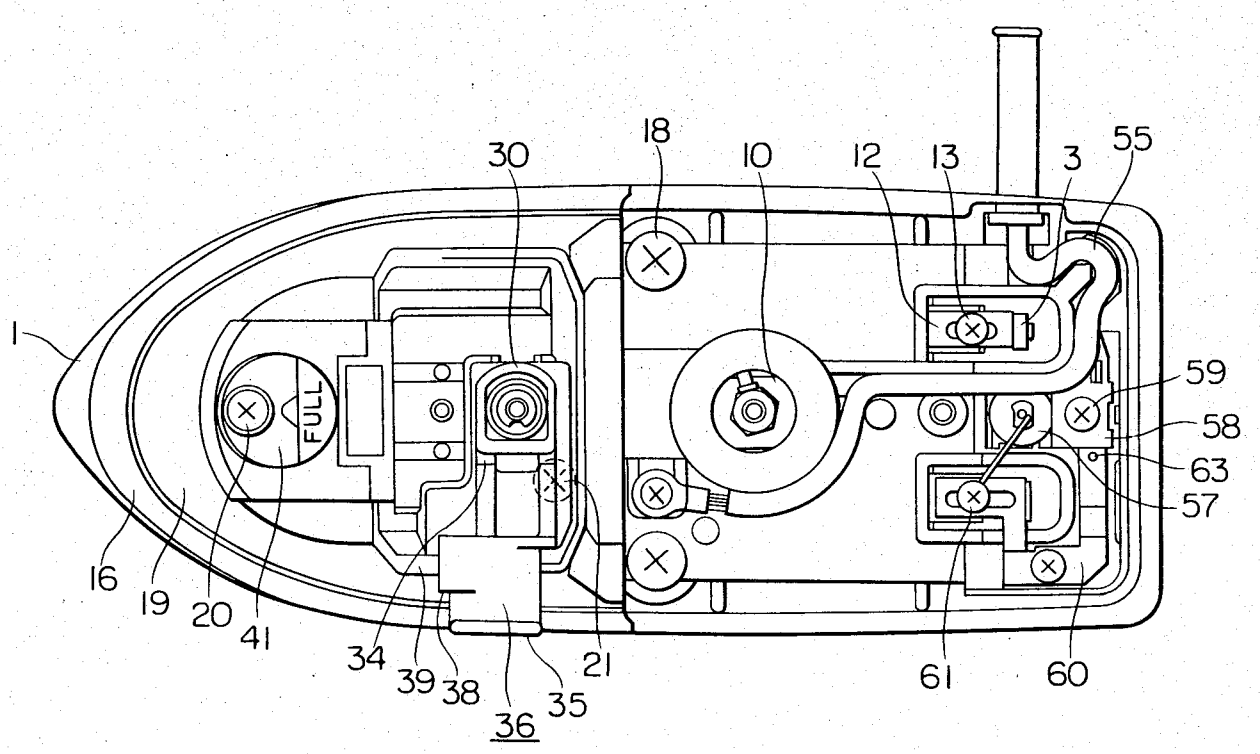
FIG. 7 is a top plan view of the travel steam iron shown in FIG. 1 with its body cover and rear cover being removed.
Figure 8:
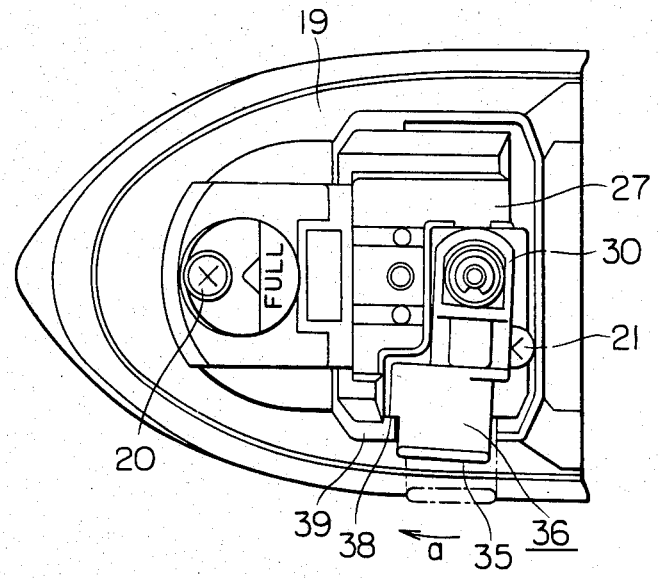
FIG. 8 is a top plan view of an essential part of the traveler steam iron with the nozzle opening and closing device operative.
Figure 9:
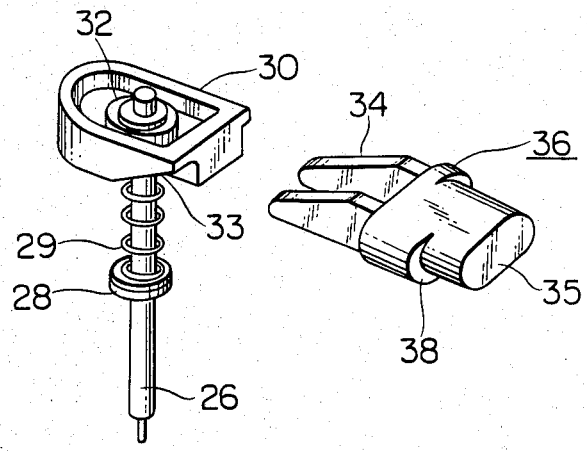
FIG. 9 is an exploded perspective view of a operating button and a cam member.

A reference numeral 16 denotes a cover provided above the base 1 and made of a heat-resistant material such as a phenol resin. As shown in FIG. 5, the cover 16 is fixed to the base 1 through a spacer 17 by means of screws 18. A reference numeral 19 denotes a body member mounted on the upper end of the cover 16 and secured thereto in an airtight manner by means of screws 20 and 21 through the intermediary of a sealant, thus defining a water tank 22. A reference numeral 23 denotes a nozzle provided in a rear portion of the bottom of the water tank 22 and having an aperture through which water is supplied from the water tank 22 into the first steam generating chamber 6. The nozzle 23 is clamped between the evaporation chamber lid 5 and the cover 16 with upper and lower packings 24 and 25 therebetween to provide a communication between the water tank 22 and the space just above the water receiving surface 7 and to prevent any leakage of water and vapor to the outside. A reference numeral 26 designates a rod (provided along the rear wall of the water tank 22) for opening and closing the nozzle 23. A numeral 27 denotes a spring for constantly biasing the rod 26 towards the nozzle 23, 28 denotes a packing for sealing the water tank 22 at the hole through which the rod 26 extends, and 29 denotes a spring for biasing the packing 28 towards the hole mentioned above. A reference numeral 30 designates a cam member for driving the rod 26 up and down. The cam member 30 is mounted on the rod 26 by E-rings 31 and 32 and is provided at its opposite sides with inclined surfaces 33 as shown in FIG. 9. A push button 36 includes tapered fingers 34 adapted for cooperation with the inclined surfaces 33 and a operating portion 35 which projects beyond the side wall of the body member 19. When the operating portion 35 of the push button 36 is depressed, the cam member 30 is subjected to two forces, one of which acts in the direction for lifting the cam member 30 and the other of which acts in the direction along which the operating portion 35 is depressed. However, the movement of the cam member 30 in the direction of the depressing force is limited by the wall 37 of the main member 19, so that the cam member 30 is moved only in the upward direction against the force of the spring 27. As a result the rod 26 also is moved upwardly to thereby open the aperture in the nozzle 23. As the push button 36 is relieved from the depressing force, the cam member 30 is lowered by the biasing force of the spring 27 to push the push button 36 out of the body member 19, and the rod 26 is lowered to shut-off the aperture in the nozzle 23. A step 38 provided on the push button 36 permits the latter to be locked in the pushed state. More specifically, by rotating the push button 36 in the direction of arrow a in FIG. 8 about the axis of the rod 26 after the push button is depressed, the step 38 is engaged by a engaging portion 39 of the body member 19, thereby keeping the nozzle 23 open.

A reference numeral 40 denotes a cap for closing a water filling port 41 on the water tank 22, and a numeral 42 designates a body cover secured to the upper side of the body member 19 by a screw 43 to define a space 22*a* above the water tank 22 and to enclose the push button 36, cam member 30 and other associated members, thus forming, in cooperation with the main body 19, an iron body which is generally designated at a numeral 44.

A reference numeral 45 designates a handle detachably secured to the iron body 44 and having a fixing portion 46 and a grip portion 47 which extend in parallel with each other and connected to each other through a bend 48. A locking button 51 consisting of a resilient web portion 49 and a retaining portion 50 is secured to the fixing portion 46 by means of a screw 52. The body cover 42 has a hole 53 for receiving the fixing portion 46 of the handle 45 and a retaining hole 54 for retaining the locking button 51 on the handle 45. During the use of the iron, the grip portion 47 of the handle 45 is mounted in parallel to and above the base 1 due to the presence of the bend 48 to provide an ample space below the underside of the grip portion 47. When the iron is not used, the handle 45 is withdrawn from the hole 53 and is turned upside down to be inserted again into the hole 53. Thus the grip portion 47 projects above the top of the iron body 44 during the use of the iron while it is positioned below the same, so that the iron as a whole becomes very compact. In the inverted state of the handle 45, the fixing portion 46 can be press-fitted in the hole 53 so that the handle is prevented from being disengaged even when vibrated during carrying.

A reference numeral 55 denotes a power supply cord having a plug 56 at its one end, while 57 denotes a diode connected in series to the power circuit of the heater 2 and intended for performing half-wave rectification. A numeral 58 designates a heat radiation plate for radiating heat produced by the diode 57. As shown FIG. 7, the diode 57 is soldered at its one end to the heat radiating plate 58 which in turn is fixed to the cover 16 by means of a screw 59. A reference numeral 60 denotes a switch spring made of a resilient material such as stainless steel and fixed, together with the other end of the diode 57, to the conductive metal fitting 3 by means of a screw 61. A numeral 62 designates an externally operable switch which is adapted to be so as to open and close the contact between contacts 63 on the switch spring 60 and the heat radiating plate 58.

Figure 11:
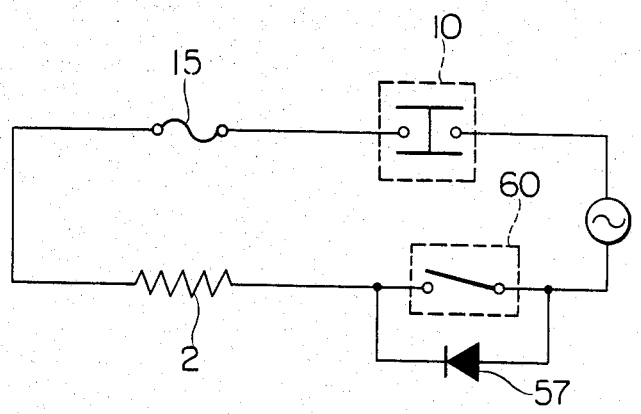
FIG. 11 is a diagram of an electric circuit incorporated in the embodiment.

The power supply cord 55, heater 2, diode 57 and the switch spring 60 constitute an electric circuit as shown in FIG. 11. This circuit is switchable by means of the switch knob 62 between two modes: namely, a first mode in which the diode 57 is connected in series to the circuit so as to effect the half-wave rectification and a second mode in which the diode is disconnected from the circuit so as to allow a full-wave rectification, thereby permitting a switching of the electric capacity, i.e., the voltage used.

A reference numeral 64 designates a rear cover secured to the base 1 by means of a screw 65 so as to cover the upper side of the cover 16. A reference numeral 66 designates a temperature adjusting knob rotatably attached to the rear cover 64 by means of a push nut 67 so as not to be able to be disengaged from the rear case 64. The temperature adjusting knob 66 is connected to the thermostat 10 so that the temperature of the pressing surface of the base 1 can be adjusted by rotating the temperature adjusting knob 66.

The travel steam iron of the invention having the above construction will be described hereinunder.

When the iron is used, the fixing portion 46 of the handle 45 is inserted into the hole 53 in the body cover 42 such that the grip portion 47 of the handle 45 is positioned upwardly. During such insertion, the elasticity of the web portion 49 causes the retaining portion 50 of the lock button 51 to be deflected downwardly and moved forwardly along the upper face of the hole 53. Upon reaching the position of the retaining hole 54, the retaining portion 50 springs back upwardly by the elasticity of the web portion 49, thus completing the locking of the handle 45. Since the grip portion 47 is offset from the fixing portion 46 of the handle 45 through the intermediary of the bend 48, an adequate space is ensured between the grip portion 47 and the rear cover 64 for an easy gripping and handling. In addition, the fixing portion 46 of the handle 45 is inserted into the body cover 16 at a position ahead of the center of the iron body 44, while the grip portion 47 is positioned rearwardly of the center of the iron main body 44. With this arrangement, a sufficiently large pressing force can be applied to the base 1 during the use of the iron to contribute to the easiness of use of the iron. Furthermore, since the handle 45 can be positively locked on the iron body 44, there is no possibility that the handle 45 would be disengaged to permit the iron to drop on the floor, thereby breaking the iron or injuring the user. Accordingly, the iron is safe to use.

When this travel steam iron is used as a dry iron, the power supply to the heater 2 is automatically controlled to maintain the desired temperature of the base 1, simply by rotating the temperature adjusting knob 66 to set the cut-off temperature of the thermostat 10.

Figure 4:
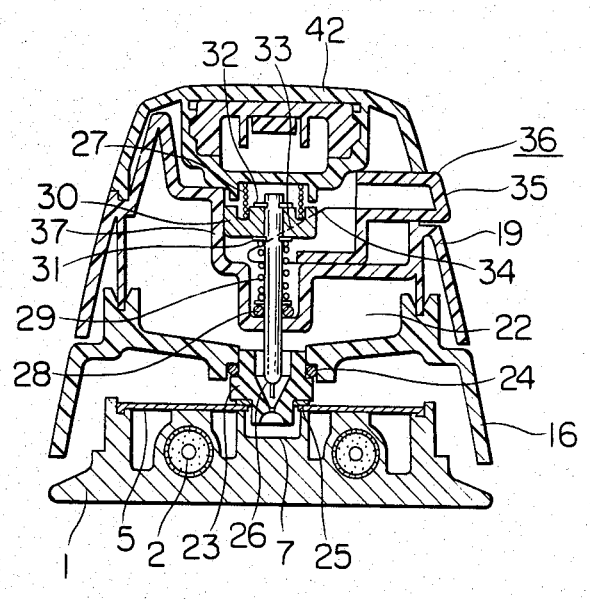
FIG. 4 is a sectional front elevational view of a device for opening and closing a nozzle.

When this travel steam iron is used as a steam iron or as a steamer, the water tank 22 is filled with water through the water filling port 41 after lifting the cap 40. As the push button 36 is depressed by a finger after closing the cap 40 as shown in FIG. 4, steam is jetted. When the push button 36 is returned to the original position upon moving a finger therefrom, the flow of the steam is stopped. More specifically, when the push button 36 is depressed, the rod 26 which is constantly urged by the spring 27 is moved upward against the force of the spring 27, thus opening the nozzle 23. Upon the opening of the nozzle 23, the water in the water tank 22 passes through the nozzle 23 to drop onto the water receiving surface 7 on the base 1 and is evaporated to become steam in the first steam generating chamber 6. The steam is then jetted outside from the second steam generating chamber 8 through the steam ports 9. When it is desired to continuously supply steam, the user presses the push button 36 and rotates the same in the direction of the arrow a about the rod 26 as shown in FIG. 8 to cause the step 38 to be retained by the retaining portion 39 of the body member 19, so that the rod 26 is upwardly moved against the force of the spring 27 to keep the nozzle 23 open, thus dripping the water continuously into the steam generating chamber. When the supply of steam is to be stopped, the step 38 is released as the push button 36 is rotated rearwardly and the biasing force of the spring 27 causes the cam member 30 to be moved downwardly, thereby forcibly moving the push button 36 outside the iron body 44. Consequently, the rod 26 is lowered to close the nozzle 23. The water receiving surface 7 disposed substantially at the center of the base 1 within the area surrounded by the U-shaped heater 2 can effectively collect the heat generated by the heater 2, so that the dripping water can be evaporated efficiently and stably. In consequence, the capacity of the heater 2 can be reduced to eliminate any waste of electric power and to shorten the time duration for supply of the electric power. This in turn suppresses the temperature rise of the various portions of the iron, thus eliminating the generation of smoke and fire and enabling safe use of the steam iron.

Since the rod 26 is provided along the rear wall of the water tank 22 and the nozzle 23 is provided at the rear bottom of the water tank 22, the water in the water tank 22 is smoothly supplied to the nozzle 23 along the rear wall of the water tank 22, when the steam iron is held in the vertical posture to be used as a steamer. It is, therefore, possible to perfectly consume all water in the water tank 22 and to prevent stoppage of the supply of steam due to the suspension of the supply of water, even when the steam iron is handled vigorously. Needless to say, the water is smoothly supplied to the steam generating chamber through the nozzle 23, when the iron is used as a steam iron.

The means for opening and closing the nozzle 23 formed by the cam member 30, push button 36 and the spring 27 are disposed at the upper side of the water tank 22 and in the vicinity of the fixing portion 46 of the handle 45, such as to be surrounded by the body cover 42. Thus, all the parts constituting the means for opening and closing the nozzle 23 are arranged in a compact manner within the body cover 42, and the push button 36 can be positioned within the reach of a finger of the user's hand when the handle 45 is gripped. In addition, since the operating portion 35 of the push button 36 projects from the side wall of the iron body 44, it is possible to reduce the overall height of the iron body 44, thus realizing a compact construction of the steam iron as a whole.

The push button 36 is arranged such that the steam is discharged when the push button is pressed towards the iron body 44. The coincidence between the finger effort for pushing the push button forwardly and the jetting of the steam provides a natural feel of operation, thus allowing the user to easily understand the operation.

The rod 26 is arranged such that the cam member 30 is lifted in response to the operation of the push button 36. So, the manual force for pushing the push button 36 is converted into a force for lifting the rod 26. Therefore, even if the rod 26 sticks onto the nozzle 23 due to generation of rust, the user can open the nozzle 23 by increasing the manual force so as to overcome the sticking force, provided that the sticking force is within a predetermined limit. Accordingly, a greater adaptability and reliability are obtained as compared with the case where a rod is lifted by the force of a spring.

Figure 10:
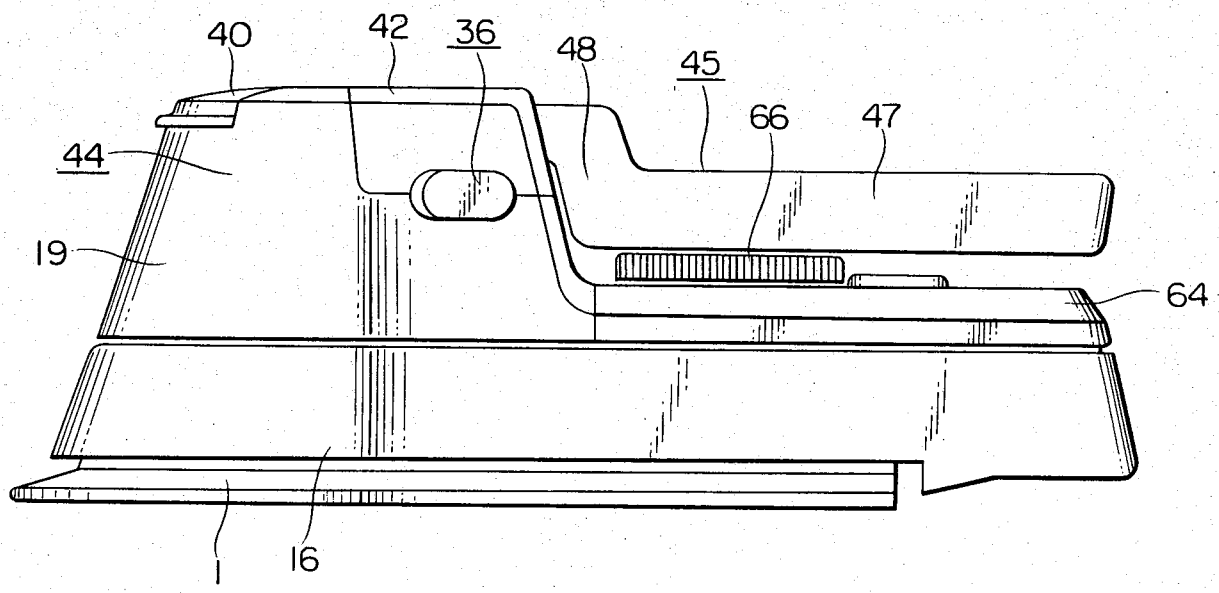
FIG. 10 is a side elevational view of a handle in the stored state.

After the use of the steam iron, the user rotates the temperature adjusting knob 66 to cut-off the electric power supply to the heater 2. Then, after a sufficient cooling down of the base 1, the user pushes the retaining portion 50 of the lock button 51, appearing through the retaining hole 54 in the main body cover 42, in the direction of the arrow b in FIG. 2, thus unlocking the same, and withdraws the handle 45 from the body cover 42. Then, as shown in FIG. 10, the user turns the handle 45 upside down such that the grip portion 47 is disposed downwardly, thereby inserting again the fixing portion of the handle 45 into the hole 53. The lock button 51 for the handle 45 is formed integrally with the retaining portion 50 which serves also as an unlocking operating portion and also with the resilient web portion 49, and this integral member is secured to the handle 45. Thus, the means for locking and unlocking the handle 45 to and from the body cover 42 has a simple and inexpensive construction and, moreover, can operate with a high reliability without fail.

The fixing portion 46 and the grip portion 47 of the handle 45 extends substantially in parallel with pressing surface of the base 1. Therefore, when the handle 45 is stored in the inverted posture, the grip portion 47 is positioned below the fixing portion 46 without projecting above the top of the iron body 44, thus affording a small overall size of the travel steam iron and facilitating carrying the iron. When the handle is in the inverted posture, the fixing portion 46 can be press-fit in the hole 53, so that, when the travel steam iron is used again, it is sufficient to withdraw the handle simply by a pulling action, without any unlocking operation. The strength of such a press fit is large enough to prevent any unintentional dropping off of the handle 45 due to vibration during carrying, so that the handle 45 does not come off when it is carried by the traveller.

Figure 12:
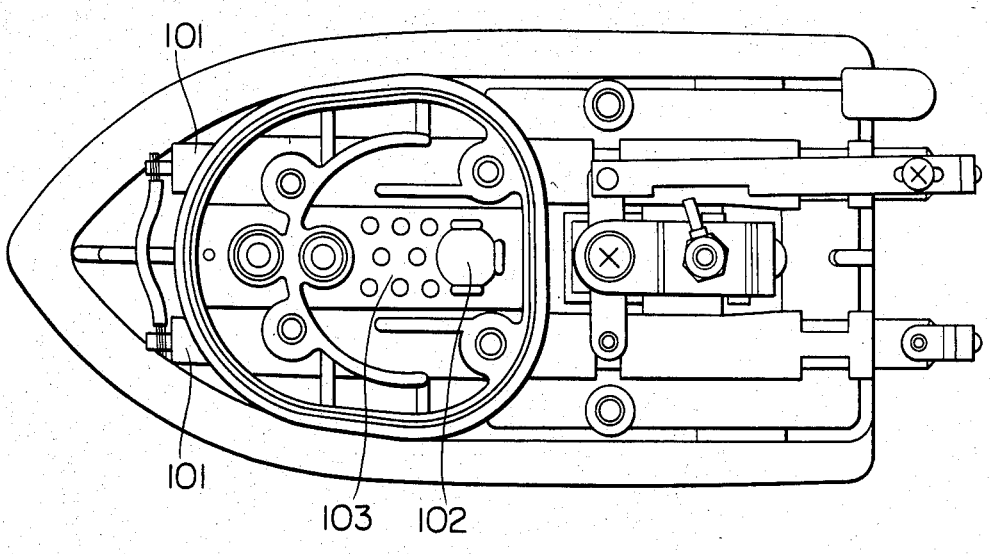
FIG. 12 is a top plan view of a base portion incorporated in another embodiment of a traveler steam iron using two heaters.

In the described embodiment, a single heater is bent to be U-shaped and the water receiving surface is provided within the area surrounded by the U-shape of the heater. This, however, is not exclusive and the arrangement may be such that a steam generating chamber 103 having a water receiving surface 102 is provided between a pair of heaters 101, as shown in FIG. 12. With this arrangement, it is possible to attain a stable generation of steam as in the case of the described embodiment which employs only one heater.

Figure 13:
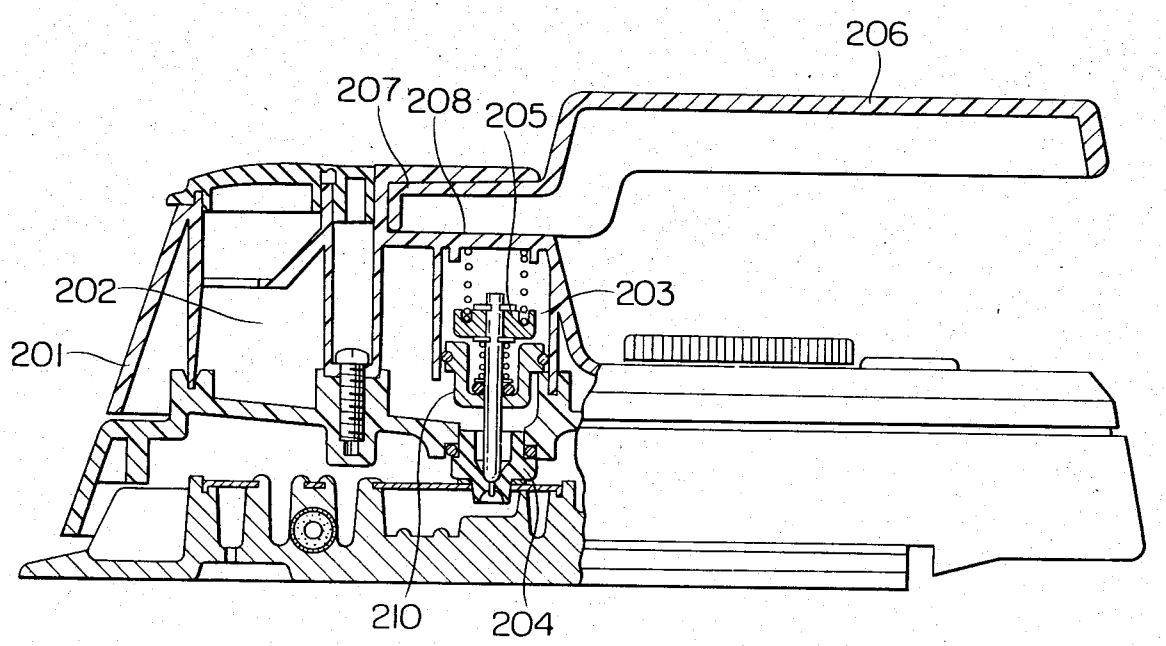
FIG. 13 is a sectional side elevational view of the embodiment shown in FIG. 13.
Figure 14:
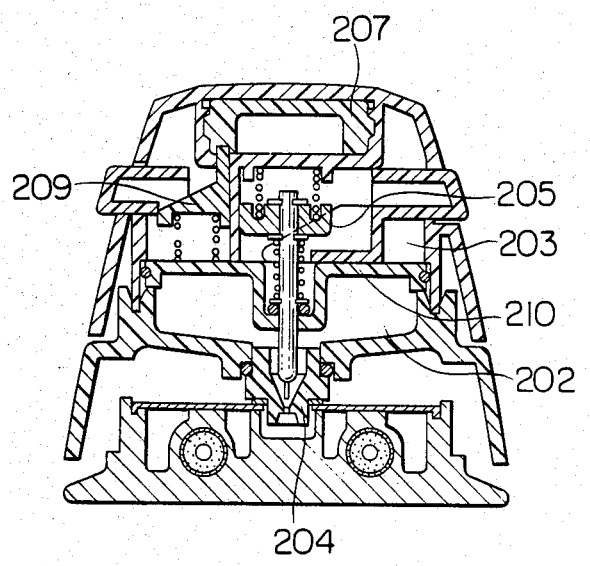
FIG. 14 is a front elevational sectional view of the embodiment shown in FIG. 12.

In the described embodiment, the means for opening and closing the nozzle 23 is provided on the body member 19 which in turn is overlaid by a body cover 40 having a hole 53 for fixing the handle 45. This is also only illustrative and this arrangement may be substituted by the arrangement shown in FIGS. 13 and 14. Namely, the water tank 202 is formed by a portion of the main body 201 such that a space 203 formed between the water tank 202 and the other portion of the main body 201 receives the means 205 for opening and closing the nozzle 204, means 208 for receiving the fixing portion 207 of the handle 206 and the means 209 for locking the handle 206. The space 203 is closed by a lid 210. This arrangement also affords a smaller size and compact construction of the steam iron as a whole, thus facilitating the portage.

As has been described, in the travel steam iron of the invention, all of the water in the water tank can be evaporated into steam and, hence, to make effective use of the heat generated by the heater, because the water receiving surface is positioned above or at the front side of the center of the base within the area surrounded by the heater or heaters.

In addition, the bend of the handle affords an easy handling during the use of the iron, as well as a compact construction easy to carry when the iron is not used.

Moreover, the manipulating portion for causing the jetting of steam is provided in the space formed above the water tank thus making an efficient use of the space while reducing the size. In addition, the fixing portion of the handle is disposed in the vicinity of the manipulating portion so that manipulating portion can be reached easily by a finger to facilitate the use of the travel steam iron.

What is claimed is:

1. An electric iron comprising: a base adapted to be heated by a heater; a steam generating chamber provided in said base; a water tank provided above said steam generating chamber; a control means for starting and stopping the feed of water from said water tank into said steam generating chamber thus allowing control of the generation of steam; a main body; and a handle; said control means including an aperture providing communication between said water tank and said steam generating chamber, and a means provided along the rear wall of said water tank for opening and closing said aperture, said aperture being provided in a rear portion of the bottom of said water tank to supply water onto a water receiving surface which is provided at the front side of the center of said base.

2. An electric iron comprising: a base having a pressing surface, a heater for heating said pressing surface; a main body provided above said base; and a handle detachably mounted on said main body, said handle having a first engaging portion, and said main body having a second engaging portion which cooperates with the first engaging portion of said handle to enabling said handle to be detachably mounted to said main body, in two different orientations, respectively, when said iron is in a use condition and in a storage condition, at least one of said engaging portions being manually movable relative to the other to enable detachment of said handle from said main body, at least when said handle is in one of said orientations corresponding to said use condition, the position where said handle is mounted on said main body in its storage condition being at the same level as or below the level of a highest portion of said main body.

3. An electric iron as set forth in claim 2, wherein said handle has a straight portion containing said first engaging portion and a grip portion extended in parallel with and connected through a bend to said straight portion, said straight and grip portions being provided parallel to the pressing surface of said base.

4. An electric iron comprising: a base adapted to be heated by said heater; a steam generating chamber provided in said base; a water tank provided above said steam generating chamber; a control means for starting and stopping the feed of water from said water tank into said steam generating chamber thus allowing control of the generation of steam; a main body housing said water tank; a handle mounted on said main body; said control means including an aperture providing communication between said water tank and said steam generating chamber, a means for opening and closing said aperture; and a manually operable means located on the side of said main body retractably projecting laterally of said main body side for operating said aperture opening and closing means.

5. An electric iron as set forth in claim 4, wherein said aperture opening and closing means is biased in a direction in which said aperture is closed, and said operating means and aperture opening and closing means contain cooperating coupling means for causing said aperture opening and closing means to open said aperture when said operating means is pushed in a direction longitudinally thereof.

6. An electric iron as in claim 5 further comprising means for holding said operating means in a position of holding said aperture open.

* * * * *